United States Patent [19]

Hermens

[11] Patent Number: 4,920,552

[45] Date of Patent: Apr. 24, 1990

[54] X-RAY APPARATUS COMPRISING AN ADJUSTABLE SLIT-SHAPED COLLIMATOR

[75] Inventor: Joannes L. G. Hermens, Hoensbroek, Netherlands

[73] Assignee: U.S. Philips Corporation, New York, N.Y.

[21] Appl. No.: 324,380

[22] Filed: Mar. 16, 1989

[30] Foreign Application Priority Data

Mar. 24, 1988 [NL] Netherlands ..... 8800738

[51] Int. Cl.[5] ..... G21K 1/04

[52] U.S. Cl. ..... 378/153; 378/4; 378/146; 378/150

[58] Field of Search ..... 378/147, 150, 151, 152, 378/153, 4, 146

[56] References Cited

U.S. PATENT DOCUMENTS 2,331,586 10/1943 Waisco ..... 378/153
4,086,494 4/1978 Malak ..... 378/153
4,158,779 6/1979 Rommel et al. ..... 378/152
4,179,100 12/1979 Sashin ..... 378/19
4,180,737 12/1979 Kingsley ..... 378/19

FOREIGN PATENT DOCUMENTS 0239759 10/1987 European Pat. Off. .
3234735 4/1983 Fed. Rep. of Germany .

*Primary Examiner*—Craig E. Church
*Attorney, Agent, or Firm*—Thomas A. Briody; Jack E. Haken; William Squire

[57] ABSTRACT

In an X-ray apparatus utilizing a fan-shaped X-ray beam the thickness of the beam is determined by a collimator of variable aperture. The X-ray beam irradiates a patient to be examined and is subsequently detected by a detector array. An image of a patient can be formed from detector signals. Using a variable aperture of the collimator, comprising two slats which are pivotable in opposite directions and a collimating side of which is provided with an X-ray absorbing material, the thickness of the X-ray beam can be varied, and hence also the thickness of the slice to be imaged.

20 Claims, 2 Drawing Sheets

X-RAY APPARATUS COMPRISING AN ADJUSTABLE SLIT-SHAPED COLLIMATOR

BACKGROUND OF THE INVENTION

1. Field of the Invention

The invention relates to an X-ray apparatus, comprising an X-ray source for generating an X-ray beam for irradiating an object to be examined, detection means for detecting X-rays having passed through the object, and a collimator which is arranged between the X-ray source and the object in order to collimate the X-ray beam so as to obtain a fan-shaped beam of adjustable thickness.

2. Description of the Prior Art

An X-ray apparatus of this kind is known from U.S. Pat. No. 4,419,764.

In the known X-ray apparatus, being an apparatus for making panoramic images, an object to be examined, for example a patient, is irradiated by a fan-shaped X-ray beam. Opposite the X-ray source there are arranged detection means for detecting the X-ray beam after passage through the patient. The detection means are shown as an X-ray sensitive film. The thickness of an irradiated slice of the patient is determined by the degree of collimation of the X-ray beam in a direction perpendicular to a plane of examination. For collimation a collimator in the form of a trunnion which is made of X-ray absorbing material is arranged near the X-ray source, said trunnion comprising a slit which extends in the axial direction. The X-ray beam emerging from the X-ray source is collimated to an adjustable thickness by rotating the trunnion around its longitudinal axis. A construction of this kind has the drawback that the edges of the collimator are easily damaged, giving rise to a beam of non-uniform thickness, and that the collimation at both sides of an X-ray beam occurs at different distances from the source, thus causing asymmetry in the X-ray beam.

SUMMARY OF THE INVENTION

It is the object of the invention to provide an X-ray apparatus comprising a collimator which has a simple construction, comprises few moving parts, collimates symmetrically at both sides of the X-ray beam, and is comparatively insusceptible to mechanical damage.

To achieve this, an X-ray apparatus of the kind set forth in accordance with the invention is characterized in that the collimator comprises two collimator slats which are pivotable in opposite directions, an X-ray absorbing material being provided at a collimating side of each slat. Because the collimator slats can occupy positions on oppositely situated circular paths, perpendicularly to the plane of examination, the dimension of the X-ray beam in the direction perpendicular to the plane of examination, and hence the thickness of an object slice to be imaged, can be accurately adjusted in a reproducible manner. Mechanical coupling of the collimator slats by means of, for example a gearwheel construction ensures that, when the collimator slats are suitably positioned, the adjustment of the collimator slit is symmetrical on both sides of the X-ray beam. X-ray absorbing material can be provided in the form of, for example a layer of lead bronze or tungsten.

A preferred embodiment of an X-ray apparatus in accordance with the invention is characterized in that a round bar of X-ray absorbing material is secured at the collimating side of the collimator slats. This bar, for example consisting of lead bronze, tungsten or other heavy elements, is secured to the collimator slat by way of a joining technique, for example pressing, welding or gluing. As a result of the absence of sharp edges, the bar is hardly susceptible to mechanical damaging.

A further preferred embodiment in accordance with the invention is characterized in that the collimator slats can be locked in a number of discrete positions. Accurately reproducible adjustment of the slit is thus achieved.

A further preferred embodiment in accordance with the invention is characterized in that the collimator slats can be displaced to two sides with respect to the position for a smallest slit aperture. The angular displacement of the collimator slats between two positions of successive magnitude of the slit aperture can thus be larger than the angular displacement obtained when the collimator slats are pivotable to one side only, so that the construction of a locking device is simplified. This embodiment is preferably used when, from a design point of view, no severe requirements are imposed on the space to be occupied by the collimator.

An X-ray apparatus in accordance with the invention is constructed notably as a computer tomography apparatus, comprising an X-ray source and a detection device which is mounted opposite thereto, which source and detection device rotate together around the object, and also comprising a collimator which rotates together with the source and the detection device and which serves to adjust the thickness of the fan-shaped X-ray beam. When use is made of the collimator in accordance with the invention, the thickness of the X-ray beam can be accurately and reproducibly adjusted, which adjustment is decisive for the quality of the X-ray image to be reconstructed.

Another special embodiment of an X-ray apparatus in accordance with the invention is characterized in that the apparatus is constructed as a slit-imaging apparatus, comprising an X-ray source which is pivotable about an axis which intersects the longitudinal direction of an object to be examined at right angles in order to irradiate an object in different directions by means of a fan-shaped X-ray beam of small thickness, and also comprising an array of detectors which are arranged opposite the X-ray source in order to detect X-rays having passed through the object, and a collimator which is arranged near the X-ray source and which rotates together with this source in order to adjust the thickness of the X-ray beam. A slit-imaging apparatus is known per se from European Patent Specification EP No. 0162512 which corresponds to U.S. Pat. No. 4,677,652. Because the X-ray source rotates about an axis extending perpendicularly to the longitudinal direction of the patient to be examined, a number of consecutive, line-shaped projection images of the patient to be examined are obtained. The width of these projection images is determined by the thickness of the X-ray beam. A fan-shaped X-ray beam having an accurately adjustable and reproducible thickness can be obtained by collimation by means of a collimator in accordance with the invention.

The invention will be described in detail hereinafter with reference to the accompanying drawing. Therein:

DETAILED DESCRIPTION OF THE PREFERRED EMBODIMENTS

Figure 1:
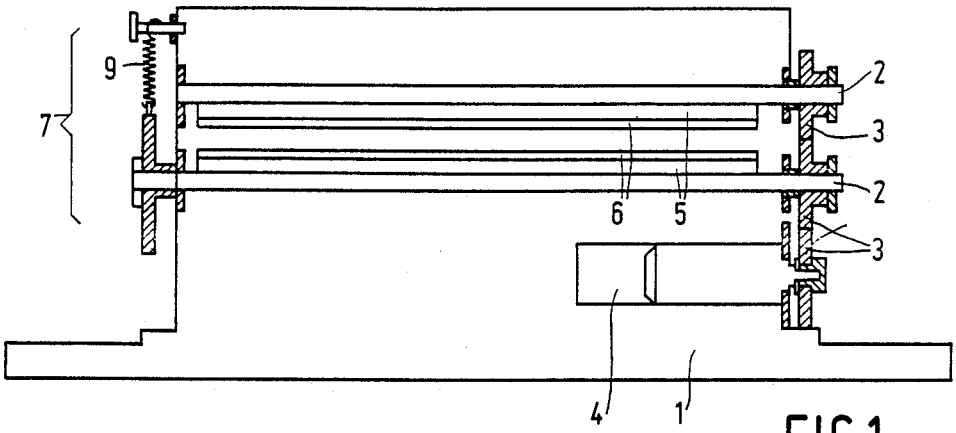
FIG. 1 is a sectional view, taken in the slit direction, of a preferred embodiment of the collimator in accordance with the invention.

FIG. 1 shows a frame 1 of a collimator, comprising collimation shafts 2 which can be driven by an electric motor 4 via a gearwheel construction 3. Under the influence of angular rotation of a shaft of the electric motor 4, collimator slats 5 are pivoted through a given angle in opposite directions, so that the X-ray absorbing edges 6 of the collimator slats 5 are moved towards or away from one another. Discrete slit positions can be adjusted by means of a locking device 7.

Figure 2:
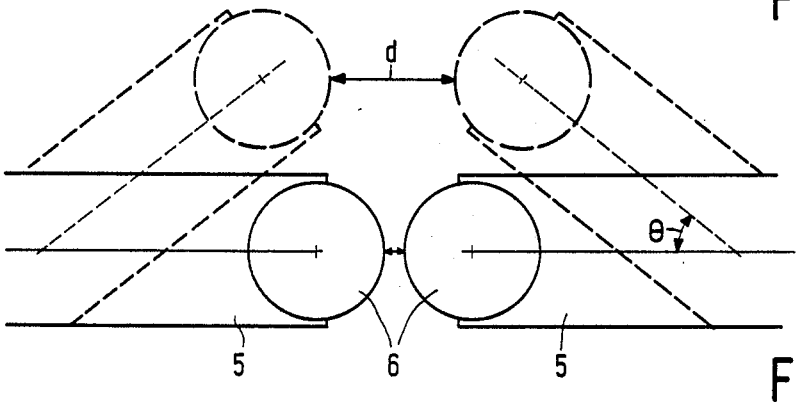
FIG. 2 is a diagrammatic side elevation of the collimator for various slit apertures.

FIG. 2 shows the collimator slats 5 in two positions. As the angular rotation of collimation shafts 2 increase, a width d of the slit aperture increases as from a smallest slit aperture produced an angular rotation $\theta$ equal to 0°. At the ends of the slats 5 there are provided round bars 6 of an X-ray absorbing material, for example lead bronze or tungsten.

Figure 3:
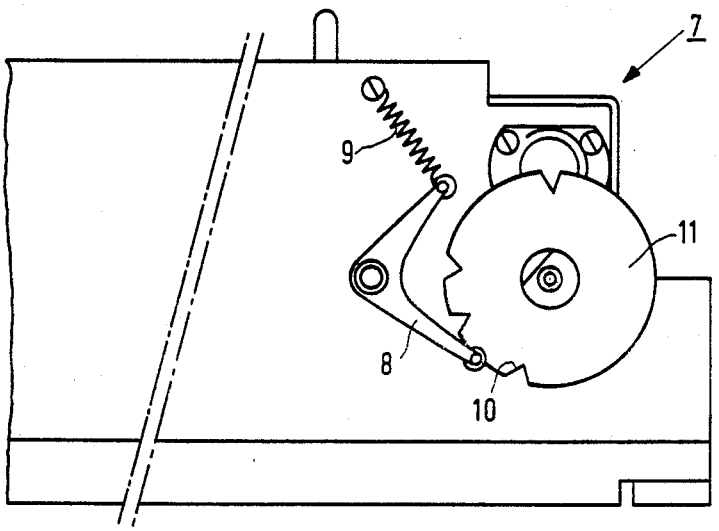
FIG. 3 is a side elevation of the locking device for the collimator, FIG. 4 diagrammatically shows a computer tomography apparatus comprising a collimator in accordance with the invention, and FIG. 5 diagrammatically shows a slit-imaging apparatus comprising a collimator in accordance with the invention.

FIG. 3 is a more detailed representation of the locking device 7. A spring 9 forces a pawl 8 into one of the recesses 10 of a cog wheel 11 mounted on the shaft of one of the collimator slats. As a result, the slats 5 can occupy a number of positions which correspond to equal angular rotations of the collimation shafts 2, the pawl 8 engaging in respective recesses 10.

Figure 4:
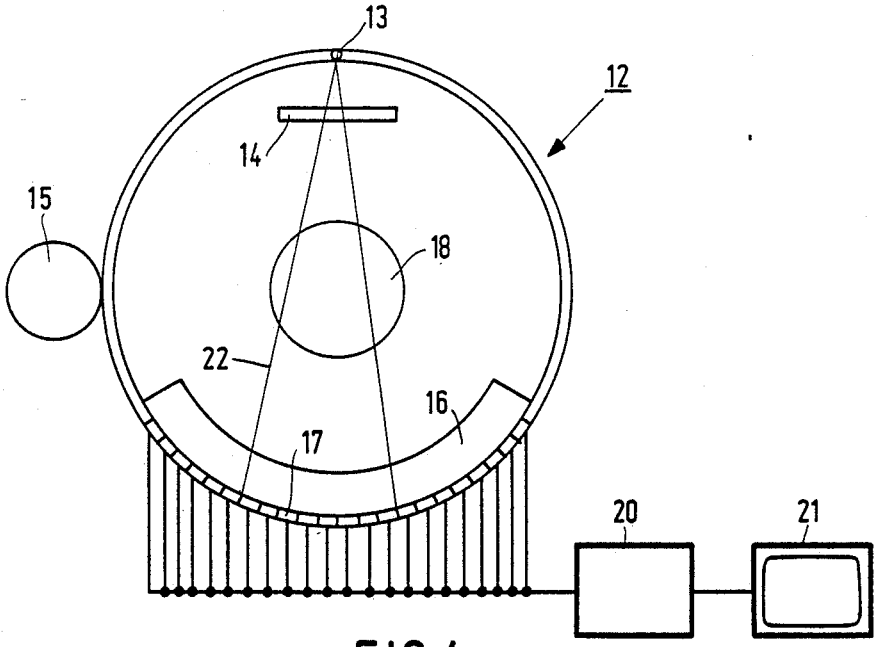

FIG. 4 diagrammatically illustrates the use of the collimator in accordance with the invention in a computer tomography apparatus 12, the following components of which are shown: an X-ray source 13 and a collimator 14 which are rotatable, together with a stray radiation grid 16 and a detector array 17, around a space 18 for an object to be examined, for example a patient, by means of a drive mechanism 15. The output signals of the detector array 17 can be reconstructed, by means of a computer 20, so as to form an image for display on a television monitor 21. The collimator is arranged so that the longitudinal direction of the slit is situated in the plane of drawing, the slit extending perpendicularly to the plane of drawing so that a fan-shaped X-ray beam 22 of the desired thickness can be adjusted.

Figure 5:
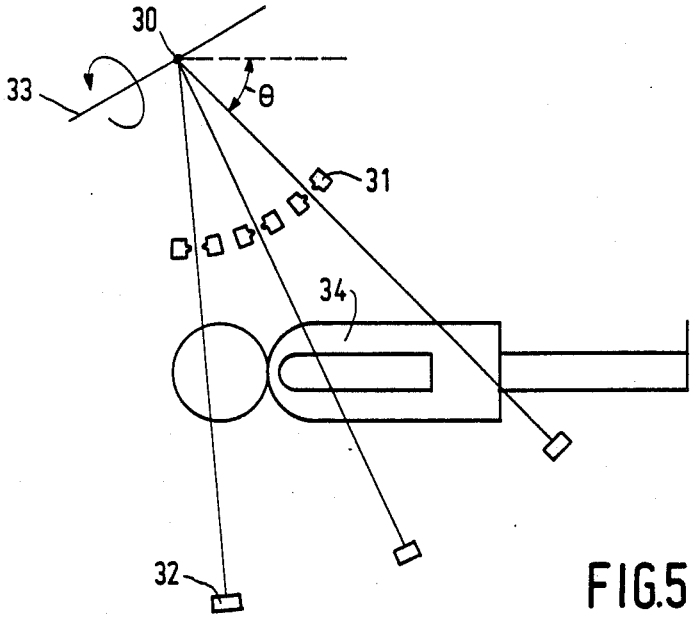

An X-ray apparatus as diagrammatically shown in FIG. 5 is a slit-imaging apparatus. An X-ray source 30 can be pivoted about an axis 33 extending perpendicularly to the plane of drawing, together with the diaphragm 31 and a detection device 32. An object 34 can be irradiated at different angles $\phi$. Three positions are shown. Using the collimator, the thickness of a fan-shaped X-ray beam can be exactly adjusted and adapted to the required imaging resolution. In FIG. 5 the plane of the fan-shaped beam, and hence the longitudinal direction of the slit of the collimator, and the longitudinal direction of a row of detectors of the detection device 32 extend perpendicularly to the plane of drawing. The thickness of the fan-shaped beam, and hence the width direction of the slit of the collimator, is situated in the plane of drawing.

I claim:

1. An X-ray apparatus, comprising an X-ray source for generating an X-ray beam for irradiating an object space, detection means for detecting X-rays from said source having passed through the object space, and a collimator which is positioned between the X-ray source and the object space in order to collimate the X-ray beam so as to obtain a fan-shaped beam of adjustable thickness for irradiating said object space, wherein the collimator comprises a pair of opposed collimator slats which are pivotable about parallel axes, each slat extending from the axis about which said slat is pivotable to a free end of said slat remote from said axis for intercepting any portions of said X-ray beam lying outside a slit aperture of desired width determining the beam thickness, each slat carrying at its free end an X-ray absorbing bar, the bars carried by the slats having respective opposed smooth arcuate surfaces for defining between the bars the width of said slit aperture, and means for angularly positioning said collimator slats about said axes.

2. An X-ray apparatus as claimed in claim 1, wherein each said bar of X-ray absorbing material has a round cross-section providing said smooth arcuate surface.

3. An X-ray apparatus as claimed in claim 1, wherein said means for angularly positioning comprises means for selectively locking the collimator slats in a number of discrete angularly spaced apart positions.

4. An X-ray apparatus as claimed in claim 1, wherein said collimator has a position of said collimator slats for a narrowest slit aperture and wherein said means for angularly positioning comprises means for pivoting the collimator slats in opposite directions with respect to the position for a narrowest slit aperture.

5. An X-ray apparatus as claimed in claim 1, characterized in that it is constructed as a computer tomography apparatus, comprising means carrying said X-ray source, said detection device, and said collimator for rotation together around the object space.

6. An X-ray apparatus as claimed in claim 1, characterized in that it is constructed as a slit-imaging apparatus comprising means carrying said X-ray source and said collimator for pivoting together about an axis which intersects the longitudinal direction of the object space at right angles in order to irradiate the object space in different directions by means of the fan-shaped X-ray beam, said detection device comprising an array of detectors which are arranged opposite the X-ray source in order to detect X-rays having passed through the object space.

7. An X-ray apparatus as claimed in claim 3, wherein each said bar of X-ray absorbing material has a round cross-section providing said smooth arcuate surface.

8. An X-ray apparatus as claimed in claim 4, wherein each said bar of X-ray absorbing material has a round cross-section providing said smooth arcuate surface.

9. An X-ray apparatus as claimed in claim 5, wherein each said bar of X-ray absorbing material has a round cross-section providing said smooth arcuate surface.

10. An X-ray apparatus as claimed in claim 6, wherein each said bar of X-ray absorbing material has a round cross-section providing said smooth arcuate surface.

11. An X-ray apparatus as claimed in claim 4, wherein said means for angularly positioning comprises means for selectively locking the collimator slats in a number of discrete angularly spaced apart positions.

12. An X-ray apparatus as claimed in claim 5, wherein said means for angularly positioning comprises means for selectively locking the collimator slats in a number of discrete angularly spaced apart positions.

13. An X-ray apparatus as claimed in claim 6, wherein said means for angularly positioning comprises means for selectively locking the collimator slats in a number of discrete angularly spaced apart positions.

14. An X-ray apparatus as claimed in claim 8, wherein said means for angularly positioning comprises means for selectively locking the collimator slats in a number of discrete angularly spaced apart positions.

15. An X-ray apparatus as claimed in claim 9, wherein said means for angularly positioning comprises means for selectively locking the collimator slats in a number of discrete angularly spaced apart positions.

16. An X-ray apparatus as claimed in claim 10, wherein said means for angularly positioning comprises means for selectively locking the collimator slats in a number of discrete angularly spaced apart positions.

17. An X-ray apparatus as claimed in claim 5, wherein said collimator has a position of said collimator slats for a narrowest slit aperture and wherein said means for angularly positioning comprises means for pivoting the collimator slats in opposite directions with respect to the position for a narrowest slit aperture.

18. An X-ray apparatus as claimed in claim 6, wherein said collimator has a position of said collimator slats for a narrowest slit aperture and wherein said means for angularly positioning comprises means for pivoting the collimator slats in opposite directions with respect to the position for a narrowest slit aperture.

19. An X-ray apparatus as claimed in claim 7, wherein said collimator has a position of said collimator slats for a narrowest slit aperture and wherein said means for angularly positioning comprises means for pivoting the collimator slats in opposite directions with respect to the position for a narrowest slit aperture.

20. An X-ray apparatus as claimed in claim 15, wherein said collimator has a position of said collimator slats for a narrowest slit aperture and wherein said means for angularly positioning comprises means for pivoting the collimator slats in opposite directions with respect to the position for a narrowest slit aperture.

* * * * *